US010127858B1

(12) United States Patent
Zhou

(10) Patent No.: US 10,127,858 B1
(45) Date of Patent: Nov. 13, 2018

(54) DISPLAY SYSTEMS AND METHODS FOR THREE-DIMENSIONAL AND OTHER IMAGING APPLICATIONS

(71) Applicant: Bo Zhou, Milpitas, CA (US)

(72) Inventor: Bo Zhou, Milpitas, CA (US)

( * ) Notice: Subject to any disclaimer, the term of this patent is extended or adjusted under 35 U.S.C. 154(b) by 242 days.

(21) Appl. No.: 14/727,812

(22) Filed: Jun. 1, 2015

Related U.S. Application Data

(60) Provisional application No. 62/006,208, filed on Jun. 1, 2014.

(51) Int. Cl.
*H05B 37/02* (2006.01)
*G09G 3/3233* (2016.01)
*G09G 3/20* (2006.01)

(52) U.S. Cl.
CPC ..... *G09G 3/3233* (2013.01); *G09G 3/2003* (2013.01); *G09G 2300/0452* (2013.01); *G09G 2300/08* (2013.01); *G09G 2320/0233* (2013.01)

(58) Field of Classification Search
USPC ..... 345/102, 205, 690, 204, 211
See application file for complete search history.

(56) References Cited

U.S. PATENT DOCUMENTS

2007/0229446 A1* 10/2007 Oh ..... H05B 33/0815 345/102
2008/0094380 A1* 4/2008 Edwards ..... G09G 3/20 345/205
2009/0167194 A1* 7/2009 Mizuta ..... G09G 3/2088 315/151
2011/0025215 A1* 2/2011 Hulett ..... H05B 33/0818 315/185 R
2013/0342586 A1* 12/2013 Kim ..... G02F 1/1313 345/690

OTHER PUBLICATIONS

Zhou et al., Light Emitting Memory: A Modular LED Panel with 10K True Color Frame Rate for 3D Display Applications, SID Symposium Digest of Technical Papers, Jun. 1-6, 2014, pp. 918-921, vol. 45, Issue 1, San Diego, U.S.A.

* cited by examiner

*Primary Examiner* — Tony Davis
(74) *Attorney, Agent, or Firm* — Bradley T. Sako

(57) ABSTRACT

A system can include a plurality of display elements arranged into groups that each include a plurality of first lines, each coupled to at least one element, and a plurality of latch circuits, each having an input coupled to receive a same shared data signal that transitions between different values, each latch circuit configured to latch and output the data signal on the corresponding first line to enable the different values to be driven on different first lines at the same time.

20 Claims, 12 Drawing Sheets

DISPLAY SYSTEMS AND METHODS FOR THREE-DIMENSIONAL AND OTHER IMAGING APPLICATIONS

This application claims the benefit of U.S. provisional patent application Ser. No. 62/006,208 filed on Jun. 1, 2014, the contents of which are incorporated by reference herein.

TECHNICAL FIELD

The present disclosure relates generally to display systems for presenting images, and in particular embodiments, systems for displaying three-dimensional images.

BACKGROUND

Among various display systems are those that use light emitting diodes (LEDs) as display elements. Pulse Width Modulation (PWM) is widely used to adjust the brightness of LEDs. In applications involving LED panels, PWM has become a dominant approach to brightness control, due to its ability to support a massive number of LEDs and the simplicity of the methodology.

To reduce the number of input/output (IO) pins, PWM signals are often multiplexed in the LED array as shown in FIG. 21. FIG. 21 shows a conventional LED array 2101 that contains m×n LEDs (one shown as 2103), where m is the number of columns and n is number of rows (in this case, m=3, n=4). At any given moment, only a subset of the LEDs is activated by the PWM signals and each one in the subset is controlled by one pin. For example, vertical line 4 is driven low and four PWM signals are sent to pins 0, 1, 2 and 3. Once the first column is illuminated, vertical line 4 is released to high and vertical line 5 is driven low in order to refresh the middle column. This process continues until all m columns are refreshed. If the refreshing rate (i.e., the frame rate) is sufficiently fast, the persistence of vision allows the whole LED array to appear to be illuminated at the same time.

LED brightness values typically arrive at a display system as digital values, which are converted into a pulse width for application to a selected LED. If the PWM resolution is p bits (representing the color depth), in general, the frame rate (f) of the LED panel is governed by the following relationship:

$$f \propto (k/N)*(1/2^p w)$$

Were w is the minimum pulse width of a p-bit PWM signal (namely, color depth is p bits), N is the total number of LEDs and k is the number of IO pins. For example, using the conventions of FIG. 21, N=m×n, and k=2mn).

From the above, the following can be observed regarding conventional LED array operations. (1) Increasing the number of IOs (k) leads to a reduced number of LEDs controlled per pin and therefore improves the frame rate. (2) Increasing the total number of LEDs (N) simply implies more tasks are to be finished by a given number of IOs and leads to lower frame rate. (3) Increasing the color depth (p) results in more time spent on each LED and therefore leads to lower frame rate. (4) Increasing the minimum pulse width of PWM signal (w) means a slower PWM signal, which produces a brighter image and lower frame rate.

Another observation is that the frame rate is directly proportional to the number of IOs (k) required to refresh all LEDs (N), which is often determined by the refreshing techniques. Table 1 below summarizes the total number of LEDs that can be controlled by k IO pins for different refreshing techniques.

TABLE 1

Total numbers of LEDs controlled by k IO pins

| Techniques | Numbers of LEDs controlled by k IO pins |
|---|---|
| Traditional Multiplexing | $k^2/4$ |
| Charlieplexing | $k(k-1)$ |

Conventional "Charlieplexing" is shown FIG. 22, and will be described in more detail at a later point herein.

For applications like three-dimensional (3D) displays, both the frame rate f and IO density (directly related to k) can be equally important. If one can refresh all LEDs with less number of pins (k) within a given period, it can lead to a simpler design and lower cost (less number of components). However, the traditional approach as shown in FIG. 21 cannot improve the fame rate without significantly increasing the number of IOs. To describe how efficiently an IO pin is utilized to control an LED panel, we define an IO frame rate efficiency (IOFRE) as follows:

$$\text{IOFRE}=f/k \propto (1/2^p wN)$$

Clearly, from the above equations, among the five parameters of frame rate (f), number of IO pins (k), color depth (p), PWM speed (w) and resolution (N), an unknown parameter is always determined by the other four known parameters. Thus, one cannot improve all of them using the approach as described above.

Conventional Charlieplexing is a popular multiplexing technique to control large numbers of LEDs, especially for applications such as LED displays. The basic principle is that there is only one pair of "1" and "0" at any time for n+1 pins and the rest of the pins are disconnected (i.e., in a high impedance, or "Hi-Z" state). Therefore, there are n(n+1) ways of using the (n+1) pins. FIG. 22 shows an LED array 2201 having a 3-pin Charlieplexing configuration which drives 6 LEDs (three shown as 2203-0/1/2). In this configuration, only one LED can be powered at a time. For example, to illuminate LED 2203-0, Y1, Y2, Y3 are required to be at 1 (i.e., high voltage), 0 (i.e., low voltage), and Hi-Z, respectively. One may notice that there appears to be two alternative LED paths (2203-1/2) when LED 2203-0 is active. However, since LED 2203-0 is activated first, it will clamp the voltage across LED 2203-1 and LED 2203-2 to its forward voltage. Half of the forward voltage drop is not able to drive either LED 2203-1 or 2203-2. Therefore, only one LED 2203-0 is visible.

FIG. 23 shows conventional Charlieplexing configuration 2301 for a set of red-green-blue (RGB) LEDs (2305-0 to -4). As shown, every row line (2307-1 to -4) shares the same cathodes of one RGB LED (LED group). Therefore, it is possible to control k*(3k+1) RGB LEDs with 3k+1 pins, where k=1, 2, 3 . . . . It is noted that we use 3k+1 (instead of n) to denote the number of pins for RGB Charlieplexing because it cannot support arbitrary number of pins (for example, 5=3*1+2). This means that each row contains k RGB LEDs (3k pins) and there are totally 3k+1 rows. FIG. 23 shows the configuration with k=1. In this configuration, each pin controls k RGB LEDs on average while the total number of pins is 3k+1.

One type of display can be a high frame rate (HFR) LED panel. Such panels are often used in 3D display applications.

A drawback to conventional HFR LED panels can be the relatively high cost. Differences between HFR LED panels and traditional LED panels (with a lower frame rate) that can lead to higher costs include: (1) an extra-large number of components. To achieve a desired frame rate, a conventional HDR system can require hundreds or even thousands of control units which are implemented using one or more processors (CPUs) and/or field programmable gate arrays (FPGAs). Compared with a traditional low frame rate LED panel, where there is only one CPU, the number of components used in an HFR system is several orders of magnitude larger. (2) A complicated interconnect structure. With such a large number of components, the interconnection among them also significantly increases. One way to address the complicated interconnect structure is to use advanced process technology like a printed circuit board (PCB) with more layers and blind-vias. However, this also significantly increases the cost. Further, such complicated structures are more difficult to debug for problems.

DETAILED DESCRIPTION

Figure 1:
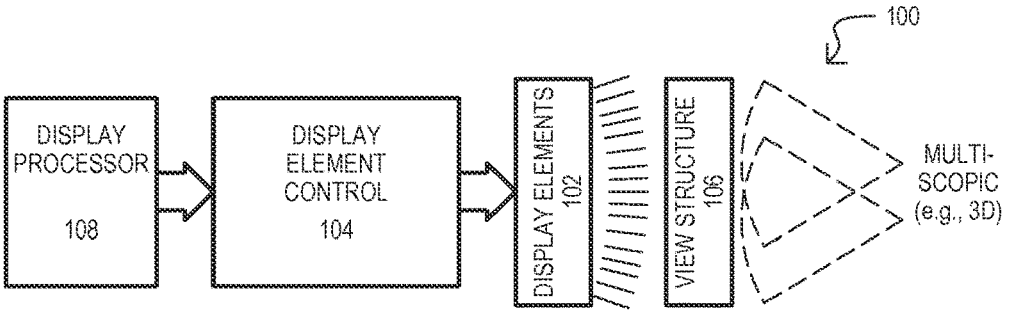
FIG. 1 is a block diagram of a system according to an embodiment.

Various embodiments will now be described that show systems and method for displaying images, including but not limited to, three-dimensional (3D) displays. According to embodiments, a display can be controlled with a reduced number of control lines (and correspondingly, a reduced number of input/output lines), as compared to conventional approaches, for increased performance for a given number of control lines and reduced cost. In addition or alternatively, embodiments can drive display elements with a current that can change in magnitude as opposed to a pulse width modulation (PWM) signal.

Embodiments can also include systems having highly-compact display element assemblies, as well as light modulation techniques for multiscopic (e.g., 3D) displays.

In the various embodiments shown below, like sections are referred to with the same reference characters but with the leading digit(s) corresponding to the figure number.

Referring to FIG. 1, a system 100 according to an embodiment is shown in block schematic diagram. A system 100 can include display elements 102 and a display element control section 104. Optionally, a system 100 can further include a view structure 106 and a display processor section 108. Display elements 102 can include elements that are controllable to generate an image. While display elements 102 can be different colored elements, they may also be monochromatic elements, as well as light emitting or light reflecting elements. In some embodiments, display elements 102 can be light emitting diodes (LEDs), including semiconductor based as well as organic LEDs (OLEDs). In a particular embodiment, display elements 102 are LEDs having relatively fast refresh rate for applications including, but not limited to, 3D displays.

Display element control section 104 can include circuits for activating particular display elements 102 to produce an image. As understood from above, activating a display element can include having the display element emit light or reflect a particular amount of light. In some embodiments, display element control section 104 can include selection circuits for selecting one or more display elements via a decoding scheme, or the like, along with driving circuits for changing the intensity of the selected display element(s).

A view structure 106 can modulate light from the display elements 106. Modulation can include varying view angles to the display elements 106 over time. Such variation can include, but is not limited to, a bending of light paths with transparent structures, including lenses, as wells as the selective blocking or filtering (e.g., color, polarization) of light from the display elements 102. According to embodiments herein, such modulation can occur by the physical movement of modulating structures. In some embodiments, a view structure 106 can enable multiscopic imaging, including but not limited to 3D stereoscopic images.

A display processor section 108 can include one or more processors that can receive image data, and transform it into a predetermined image format for application to display element control section 104. As but one of many possible implementations, a display processor 108 can output a series of pixel values that include pixel position in the image and pixel intensity. In some embodiments, a display processor section 108 can output frames of image data corresponding to a 3D image. A view structure 106 can be synchronized to such frames to provide a desired effect, such produce images that vary according to relative viewing position (e.g., stereoscopic effect).

Figure 2:
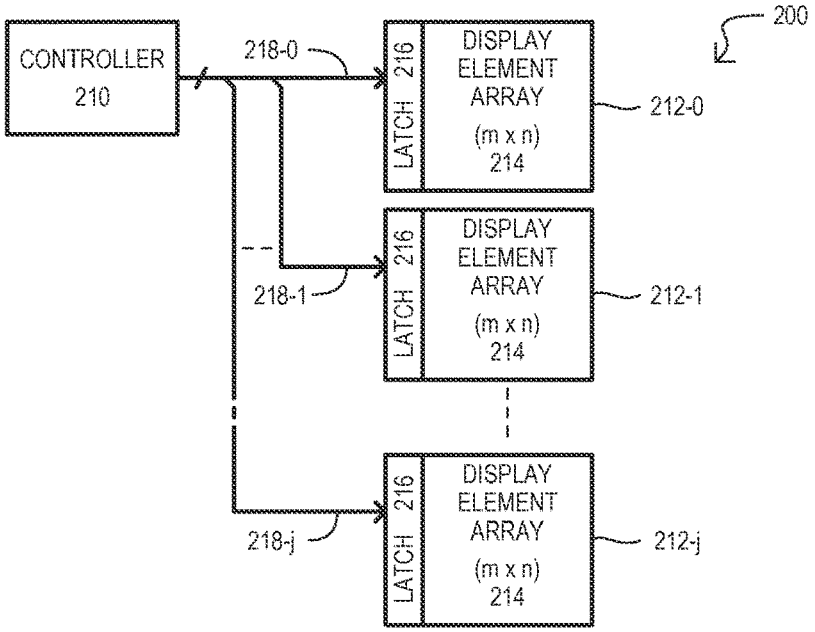
FIG. 2 is a block diagram of a system that can perform interleaved pulse width modulation (PWM) according to an embodiment.

FIG. 2 is a block schematic diagram of a system 200 according to a particular embodiment. System 200 can control a set of display elements with a smaller number of control lines by enabling the driving signals for a different display element (or set of elements) to be maintained (e.g., latched) over a same time period, rather than time multiplexing each separate display element, as in a conventional approach (such as those shown in FIGS. 21-23). A system 200 can include display element groups 212-0 to –j and a controller 210.

Display element groups (212-0 to -j) can each include an array of display elements 214 as well as a corresponding latch circuits 216. In the particular embodiment shown, each array of display elements 214 can include an m×n array of LEDs. However, alternate embodiments can include different types of display elements. In operation, multiple display elements within each group (212-0 to -j) can be activated over the same time period. In particular, latch circuits 216 can latch values presented data lines 218-0 to -j at different time periods, and apply such values to one or more display elements. Thus, multiple display elements in each array 214 can be active at the same time in response to a same shared control signal. According to embodiments, data lines (218-0 to -j) can be single data lines that carry binary values. Thus, the values of multiple display elements in each array 214 can be established by a single data line (e.g., 218-0 to -j).

Controller 210 can generate data signals on data lines (e.g., 218-0 to -j) for multiple display elements in the corresponding display element group (212-0 to -j).

In a particular embodiment, display elements can be activated by a PWM signal (e.g., LED brightness), and latches 216 can latch values presented on data lines (e.g., 218-0 to -j) to apply a PWM signal to different elements over the same time period. This will be referred to herein as "interleaving PWM". Such an embodiment can improve an input/output 10 frame rate efficiency (IOFRE) by increasing a frame rate without adding significantly more IOs. Interleaving PWM is based on the observation that data lines (218-0 to -j) (e.g., I/O pins) can retain their values most of the time during a full PWM cycle. While producing a PWM signal based on a p-bit signal, a data signal can toggle at most p times, which means only pw out of the $2^p$w total time (as in the conventional case) is utilized. According to embodiments, a single data line (e.g., I/O pin) can be shared among a set of PWM signals through interleaving of the PWM signals.

Referring still to FIG. 2, according to embodiments, a number of display elements can be divided into smaller groups (212-0 to -j) and can complete refreshing multiple groups within a full PWM cycle. Latches 216 can ensure that data lines (218-0 to -j) (I/O pins) are continuously utilized without wasting any bandwidth. A controller 210 (e.g., host) can take care of data transactions and latches 216 can take care of data holding. Therefore, one set of data lines (218-0 to -j) (e.g., host I/Os) can be shared by multiple latches 216, thus reducing the required number of data lines (218-0 to -j) for a given number of display elements 214.

Having described interleaving PWM, particular interleaving PWM approaches will now be described. Given q PWM signals $$\{S_i|0\leq i\leq q-1\},$$

each of p-bits, whose duty cycles are $$\{D_i|0\leq Di\leq 2^p w,\ 0\leq i\leq q-1\},$$

respectively, the q PWM signals can be sent through one shared pin to p single-bit registers, which can drive p display elements. If we denote the refreshing time of q display elements as $$T(2^p w\leq T\leq 2^p wq),$$

interleaving PWM can be used to construct a schedule for sharing the pin in order to achieve the shortest average refreshing time (T/q).

Interleaving PWM according to embodiments can be based on the observation that the control of a display element (e.g., brightness of an LED) can be related to its "ON-time" (the duration when it is turned on), within the whole PWM cycle ($2^p$w). To achieve a duty cycle of $D_i$, one can activate the display element once and keep it on for $D_i$ time duration. One can also turn on/off the LED multiple times as long as the total ON-time equals to $D_i$. Due to the persistence of vision, the latter appears the same to the human eye as the former when refreshing is finished fast enough. According to embodiments, display elements (e.g., LEDs) maintain essentially a same state while on (i.e., activated). For example, one only needs to turn a LED on at the beginning and turn it off at the end of a duty cycle of $D_i$. Nothing needs to be changed for the LED during the rest of $D_i$−2w time (hold time).

Figure 3:
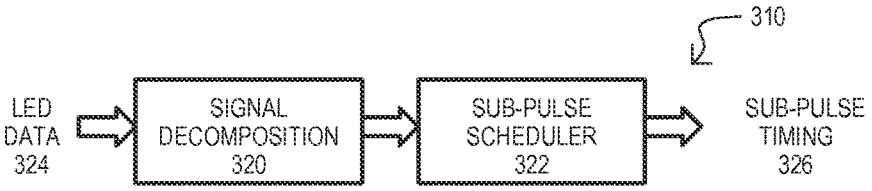
FIG. 3 is block diagram of a controller for performing interleaved PWM according to an embodiment.

FIG. 3 shows a controller architecture 310 for implementing interleaved PWM according to an embodiment. Controller architecture 310 can include a signal decomposition stage 320 and a sub-pulse scheduler stage 322. Signal decomposition stage 320 can receive display element data (i.e., pulse widths for multiple LEDs), and decompose such multiple pulse widths into sub-pulses of various duration. Sub-pulse scheduler stage 322 can then order the start and/or end of such sub-pulses to enable such sub-pulses to be active over a same time period.

As but one example, a p-bit brightness requirements of q LEDs (namely, $$\{Di|0\leq Di\leq 2pw,\ 0\leq I\leq q-1\})$$

can be sent to a signal decomposition stage 320. Each requirement (Di) is then decomposed into a group of sub-pulses, which can be expressed as $$G_i=\{(b^i_y,e^i_y)|D_i=\Sigma_{y=0,1\ldots}(e^i_y-b^i_y),e^i_y-b^i_y\}$$

where each sub-pulse starts at $b^i_y$ and ends at $e^i_y$. After we have p groups of sub-pulses ($G_0$~$G_{p-1}$), they are passed to a sub-pulse scheduler stage 322, which can send the sub-pulses to the LEDs. During this process, a sub-pulse scheduler stage 322 can determine the order of sub-pulses to finish refreshing as fast as possible (where such sub-pulses correspond to multiple different LEDs). It is noted that controller architecture 310 can be static, executing a predefined a decomposition scheme or dynamic, allowing the controller architecture 310 to determine the best decomposition scheme based on content during runtime.

According to embodiments, a two-stage processing architecture, like that of FIG. 3, can meet the following constraints, given q, p-bit values: the interleaved PWM can produce q PWM signals that satisfying all display requirements given ($2^p$) (i.e., any brightness requirement for each LED); a total time spent on refreshing q LEDs is consistent across frames (this means the time spent on each frame is a constant regardless of the displayed content); a minimum refreshing time can be set to accommodate for different resolutions of PWM signal (p-bits); and a brightness requirement of each LED is decomposed into a number of smaller pulses (called sub-pulse) which in total, do not change the total ON-time of the LED (as compared to the conventional PWM pulse approach which issues single pulses to LEDs that do not overlap in time).

Figure 4A:
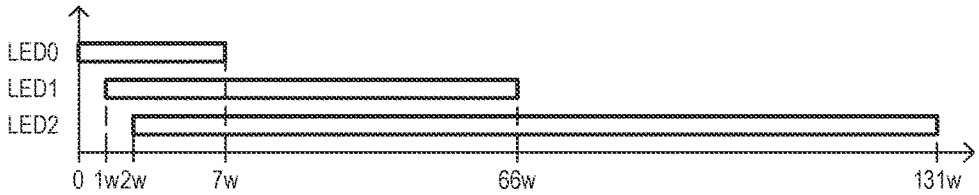
FIGS. 4A and 4B are diagrams showing principles of interleaved PWM according to embodiments.

Some principles of interleaved PWM according to embodiments will now be described. For simplicity, we assume there are only three LEDs (LED0 to LED3) to be refreshed and their duty cycles are 7w, 65w and 129w, where the PWM resolution is assumed to be 8 bits and the minimum PWM pulse width is w. Conventionally, all three LEDs would be illuminated sequentially in their designated time-multiplexed slot (256*w), and refreshing would take 3*256*w to complete. In sharp contrast, as shown in FIG. 4A, activation of LEDs can be latched to enable more than one LED to be active at a time. FIG. 4A shows how a LED0 can be activated at time 0, while the next LEDs (LED1 and LED2) can be activated at times 1*w and 2*w, respectively. Subsequently, LED0 can be deactivated at time 7*w. Similarly, the LED1 and LED2 can be deactivated at times 66w and 131w, respectively, to meet the duty cycle requirements. As understood from FIG. 4A, three LEDs can be refreshed within 256w, which is 3 times faster than sequential refreshing.

In the above example, refreshing each LED is done by a single activation during the time interval of 256w. However, as mentioned above, one can activate an LED multiple times as long as the duty cycle requirement is met. For example, to achieve a duty cycle of 65w, one may choose to activate a display element three times, with each pulse lasting 5w, 20w, and 40w, respectively (65w=5w+20w+40w). Clearly, there are many combinations of activation patterns to satisfy a specific duty cycle. For example, one can choose only two activations and they last 1w and 64w, respectively (65w=1w+64w). Since each sub-pulse requires at least one host operation, less number of sub-pulses generated from decomposition stage leads to more bandwidth that a host can spend to refresh other LEDs. However, less number of sub-pulses also means less flexibility that the scheduler can leverage to shuffle the sub-pulses and it could essentially lead to worse overall performance. Therefore, the process of interleaving PWM can include both proper decomposition as well as judicious scheduling.

Figure 4B:
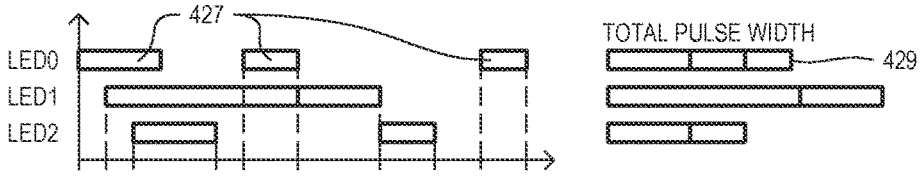

FIG. 4B is a timing diagram showing how sub-pulses can be generated for various display elements (LED0, LED1, LED2). In the embodiment shown, sub-pulses can each have different (non-coincident) start times and end times. In particular for LED0, there can be three sub-pulses 427, which together arrive at a desired duty cycle 429.

Figure 5:
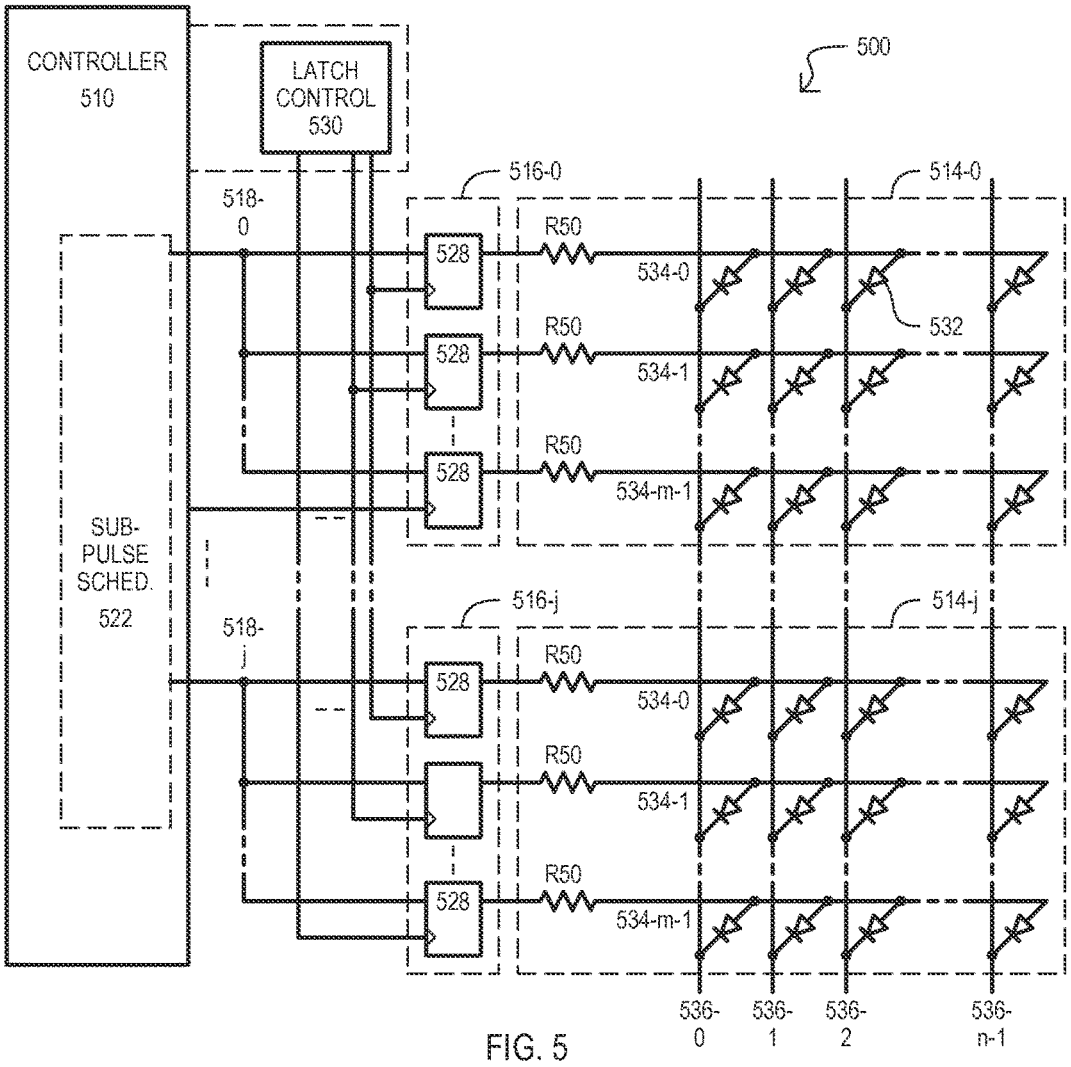
FIG. 5 is a block schematic diagram of an interleaved PWM system according to a particular embodiment.

FIG. 5 shows a system 500 according to another embodiment. System 500 can be one very particular implementation of that shown in FIG. 2. System 500 can include LED sub-arrays 514-0 to -j, latches 516-0 to -j corresponding to each LED sub-array, and a controller 510. LED sub-arrays (514-0 to -j) can include m×n LEDs (one shown as 532), with LEDs of the same row being connected to a same row line (534-0 to -*m*−1) and LEDs of the same column being connected to a same column line (536-0 to -*n*−1). In the particular embodiment shown, row lines (534-0 to -*m*−1) can each include a series resistor R50.

Latches (516-0 to -j) can each include a one bit latch 528 corresponding to each row line (534-0 to -*m*−1). Each bit latch 528 can have an input connected to a same data line (518-0 to -j) and an output connected to its corresponding row line (534-0 to -*m*−1) (via resistor R50 in this embodiment). Thus, as values are presented for different LEDs on data lines (518-0 to -j), they can be latched by corresponding bit latches 528 and held (e.g., driven) on the corresponding row line (534-0 to -*m*−1). In the particular embodiment shown, bit latches 528 can be clocked latches controlled by a latch control circuit 530.

It is noted that while the timing of latching signals generated by latch control circuit 530 can vary according to the decomposition/sub-pulse scheduling scheme employed, once the scheme has been set, the timing of latch control circuit 530 can be the same regardless of the data values being output on the data lines (518-0 to -j). A latch control circuit 530 can be part of a controller 510 or separate from controller 510.

Controller 510 can include a sub-pulse scheduler stage 522, as described for other embodiments herein, or equivalents. Sub-pulse scheduler stage 522 can generate data signals on data lines 518-0 to -j that include a series of values corresponding to different sub-pulses of different LEDs in a same array (514-0 to -j).

Figure 21:
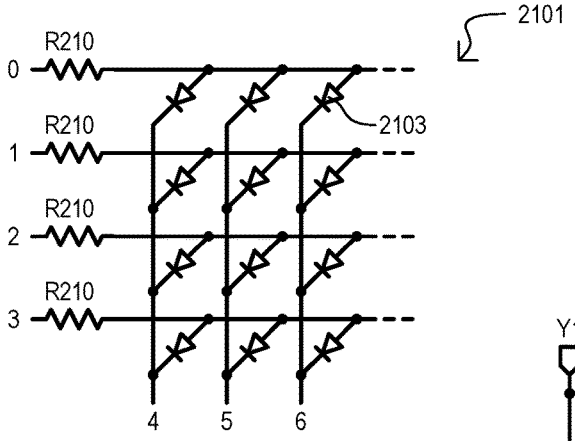
FIG. 21 (BACKGROUND ART)
FIG. 21 is a schematic diagram of a conventional LED array.
Figure 22:
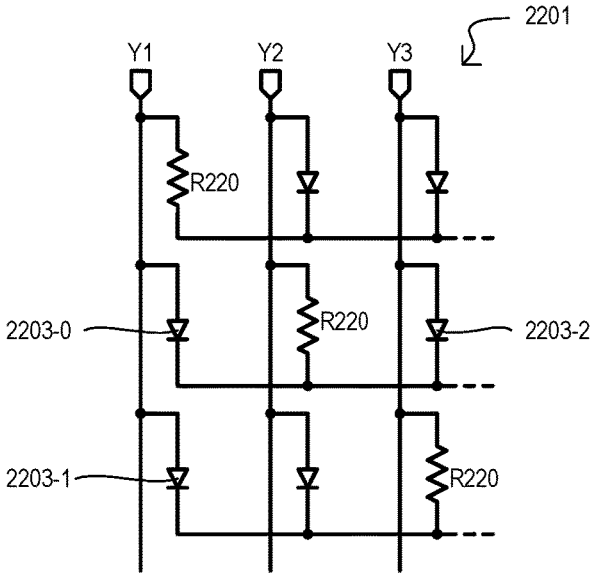
FIG. 22 (BACKGROUND ART)
FIG. 22 is a schematic diagram of a conventional LED array having a Charlieplexing configuration.
Figure 23:
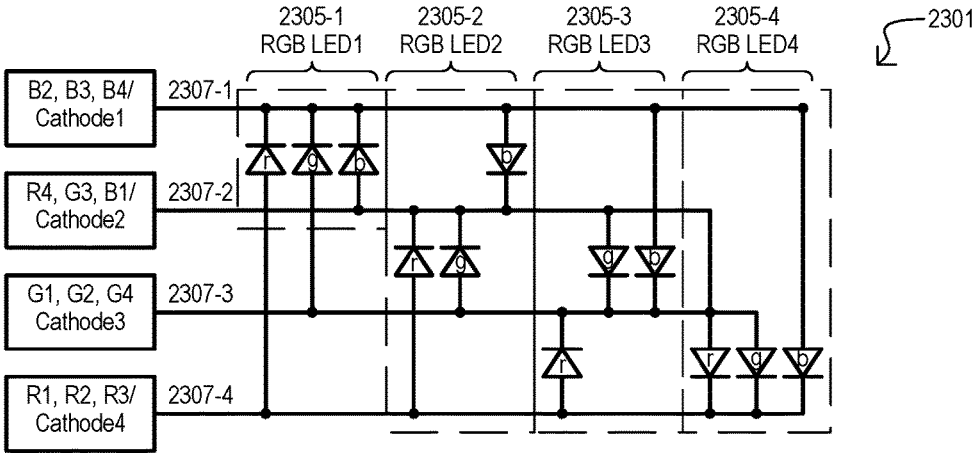
FIG. 23 (BACKGROUND ART)
FIG. 23 is a schematic diagram of a conventional RGB LED with common cathode connections and Charlieplexing.

Referring still to FIG. 5, it is understood that in contrast to conventional approaches, like those of FIGS. 21 to 23, m rows of LEDs can be controlled by one data line (i.e., the m rows of array 514-0 are controlled by the single data line 518-0). Accordingly, if jm×n LED sub-arrays (514-0 to -j) share j data lines and each row within a sub-array (534-0 to -*m*−1) has a latch 528 in front of it, a controller 510 can provide data for each sub-array (514-0 to -j) sequentially while satisfying the brightness requirement of each LED. Interleaved PWM can enable a given number of data lines (e.g., pins) to refresh a corresponding sub-array (514-0 to -j) in a very short time period relative to conventional approaches, like those of FIGS. 21 to 23.

Referring still to FIG. 5, in the embodiment shown, a refreshing of column signals can be performed sequentially via column lines (536-0 to -*n*−1). However, by inclusion of latches (516-0 to -j), multiple (i.e., m) rows of LEDs can be refreshed in the same time a conventional approach, like that of FIG. 21, would refresh but one row.

Interleaved PWM can be conceptualized as sending m PWM signals (each corresponding to p-bits) to m LEDs via a single data line (e.g., 518-0) and m bit latches 528. A minimum time to refresh one LED can be $2^p$w. Interleaving PWM can finish all (i.e., m) LEDs in about this same time period, thus having a lower-bound of refreshing time of about $2^p$w. In very sharp contrast, conventional LED refreshing schemes would refreshing each LED sequentially, and thus have an upper-bound of refreshing time of $2^p$w*m.

While interleaved PWM can take various forms, one very particular example will now be described. In an exemplary case, decomposition can take a predefined form corresponding to the binary representation of display element control data (e.g., multi-bit LED brightness values). In the decomposition form, assuming p-bit data values, there can be a sub-pulse for every p-bit brightness requirement (Di). A length of each sub-pulse reflects its index in Di (1w, 2w, 4w, 8w . . . ) (i.e., its significance in the p-bit order).

Assuming p=8, one signal line can be used to generate eight 8-bit PWM signals for every 256w. Such an approach is shown in Table 2.

TABLE 2

| Interleaving PWM (unit: w) | | | | | | | | |
|---|---|---|---|---|---|---|---|---|
| | b0 | b1 | b2 | b3 | b4 | b5 | b6 | b7 |
| W0 | 1-2 | 20 | 56 | 256 | 18 | 52 | 120 | 248 |
| W1 | 3-4 | 38 | 106 | 258 | 250 | 36 | 102 | 234 |
| W2 | 5-6 | 72 | 204 | 260 | 252 | 236 | 70 | 200 |
| W3 | 7-8 | 138 | 158 | 262 | 154 | 254 | 222 | 136 |
| W4 | 9-10 | 28 | 64 | 264 | 26 | 60 | 128 | 256 |
| W5 | 11-12 | 46 | 114 | 266 | 258 | 44 | 110 | 242 |
| W6 | 13-14 | 80 | 212 | 268 | 260 | 244 | 78 | 208 |
| W7 | 15-16 | 146 | 166 | 270 | 162 | 262 | 230 | 144 |

In Table 2, W0-W7 is the brightness requirements of 8 LEDs, and such brightness requirements are 8-bits wide (b0-b7). The values shown in the table indicates the time stamp (in units of w) when the refreshing of the corresponding bit is done. For example, W0.b0 is updated between 1w-2w. Then, instead of updating W0.b1, W0.b4 is updated, which needs to last 16w (from 2w to 18w). During this 16w time period, a controller can switch to update the least significant bits of all the other words (W1.b0-W7.b0). When it reaches the timestamp of 18w, W0.b1 can be updated which only lasts 2w. This process can continue until all the bits (Wx.bx) are updated. The latency is 16w and can be ignored while the 8 LEDs are updated continuously with PWM signals. This leads to an average refreshing time of 256w/8=32w for each LED, which is an 8×improvement over a conventional approach, such as that shown in FIG. 21. It is understood that there can be a certain latency for each word. For example, W7 is refreshed between 15w-270w. However, after the initial latency, each word will be finished within 256w.

Figure 6:
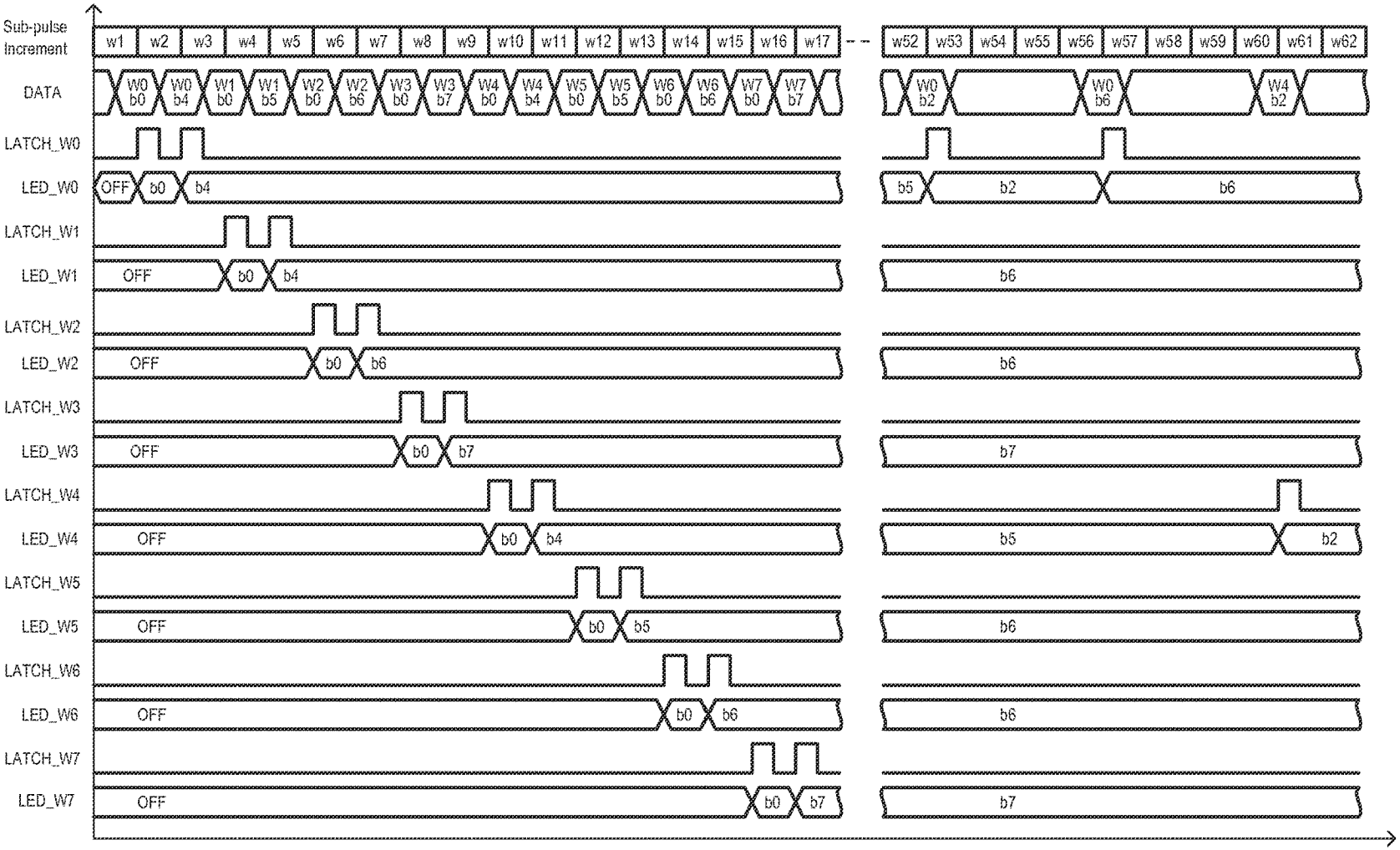
FIG. 6 is a timing diagram showing one particular implementation of the interleaved PWM shown in Table 2.

FIG. 6 is a timing diagram showing one very particular operation for executing the interleaved PWM method shown in Table 2. FIG. 6 shows the following: sub-pulse increments as w1 to w62 (which are understood to continue onward to from w63 to w270); DATA, which can be the data value (i.e., high or low) corresponding to a bit of a word (i.e., W0 b0) is bit b0, of word W0 for led LED_W0; LATCH_W0 to LATCH_W7 can be activation signals for bit latches corresponding to the LEDs; LED_W0 to LED_W7 can be the sub-pulses applied to LEDs based on latched values of DATA.

It is understood that Table 2 and FIG. 6 show a decomposition/sub-pulse scheduling scheme according to one very particular embodiment. Alternate embodiments can include a dynamic decomposition form, for example, changing the decomposition form based on the input content.

While interleaved PWM as disclosed herein, and equivalents, can be applied to any display arrangement having elements activated by PWM, such systems and methods may provide particular benefits for 3D applications. It can be extremely important for 3D displays to attain both good performance and highly constrained cost. With the interleaving PWM, the cost due to the extra latches can be considerably lower than using a CPU/FPGA multiple times with more data lines (e.g., IO pins).

While embodiments can include control of display elements with PWM signals, including interleaved PWM, alternate embodiments can utilize an alternate approach to PWM. Conventionally, PWM-based methods have been the conventional light modulating approach for LED-based display. This is primarily due to their simplicity and controllability. Although analog-based modulating methods are also feasible for adjusting the intensity of LED (due to the fact that LED is a current-sensitive component), analog methods are mainly used in LED lighting or controlling a limited number of LED dimming levels at low frequency. In LED display applications, adjusting the LED brightness directly by changing current has not been adopted for the following reasons: (1) PWM-based methods are able to meet the requirements of existing applications; (2) for a large quantity of LEDs, the control and consistency of the display system can become problematic.

However, as the frame rate of LED displays improves, especially for those displays with a very high frame rate (HFR, >5,000 frames per second), PWM-based methods can present short comings unless more sophisticated components are incorporated in the design. As noted above, in conventional approaches it can take a time of $2^p$w to complete the modulating of one p-bit PWM signal on one LED, where w is a minimum PWM pulse width.

It is noted that there can be a hard limit for w: The pulse needs to last longer than the LED switching time, which is mainly determined by the physical properties of LED. Compared to the speed of processors (GHz), the LED switching speed is normally in the range of 10-100 MHz, which is two orders of magnitude slower. Accordingly, it is challenging to produce an LED display with very high frame rates (over 10,000 frames per second).

According to some embodiments, a variable current can be generated and selectively applied to display elements to modulate their operation. Such approaches are referred to herein as direct current injection (DCI). A DCI system can generate variable current in an analog fashion so that the conversion from a p-bit value to such a current can be done in a much shorter time than a conventional PWM approach (i.e., $2^p$w). A generated current can then be routed to a desired display element (e.g., LED) using a routing structure.

Various DCI embodiments will now be described. It is understood that while the embodiments show current sources that generate and output variable current, alternate embodiments can include current sinks that receive a current from a display element array. Further, while some of the embodiments show a particular type of selection of display elements, any selection method described herein could be used, including but not limited to conventional row/column selection, conventional Charlie-plexing, or "common terminal" Charlie-plexing (described in more detail below).

Figure 7:
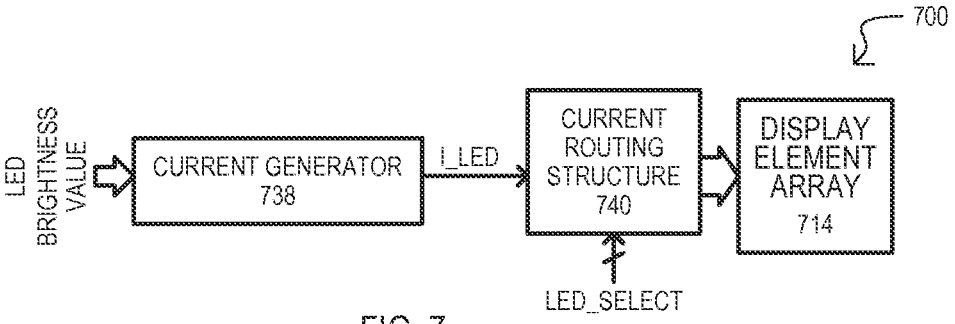
FIG. 7 is a block schematic diagram of a system that can provide direct current injection (DCI) to display elements according to an embodiment.

FIG. 7 is block schematic diagram of a DCI system 700 according to an embodiment. A system 700 can include a current generator circuit 738, a current routing structure 740, and an array of display elements 714. A current generator circuit 738 can receive modulation values (e.g., LED brightness values) and can convert such values into a current I_LED. Current routing structure 740 can apply the current I_LED to one or more display elements based on selection data (LED_SELECT). Array 714 can include display elements having properties that can vary according to the magnitude of an applied current, including but not limited to LEDs.

Figure 8:
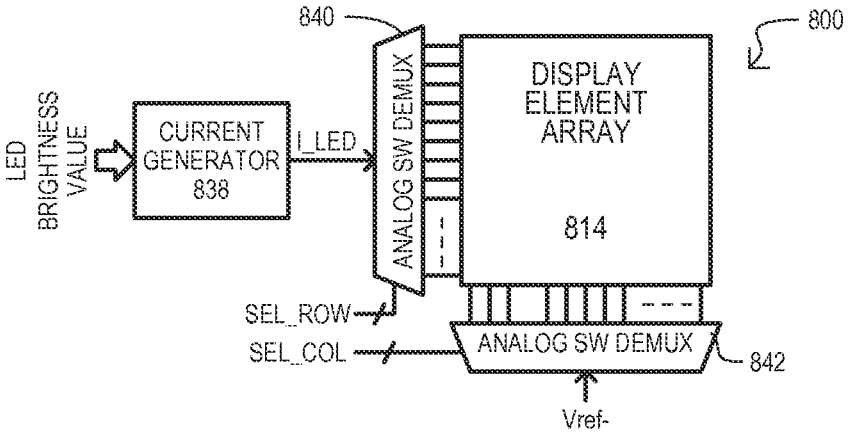
FIG. 8 is a block schematic diagram of a system that can provide DCI to display elements according to another embodiment.

FIG. 8 is block schematic diagram of a DCI system 800 according to an embodiment. A system 800 can be one particular implementation of that shown In FIG. 7, including a current generator circuit 838 and array of display elements 814 like those of FIG. 7.

FIG. 8 differs from FIG. 7 in that a current routing structure 840 can be a de-multiplexing circuit (DMUX) 840 formed of analog switches. Analog switches can provide fast and low resistance paths for the generated current I_LED to a given row of display elements according to row select data SEL_ROW. A system 800 can further include a column DMUX 842, which can select a given display element (i.e., provide a current path) according to column select data SEL_COL to complete a current path.

Figure 9:
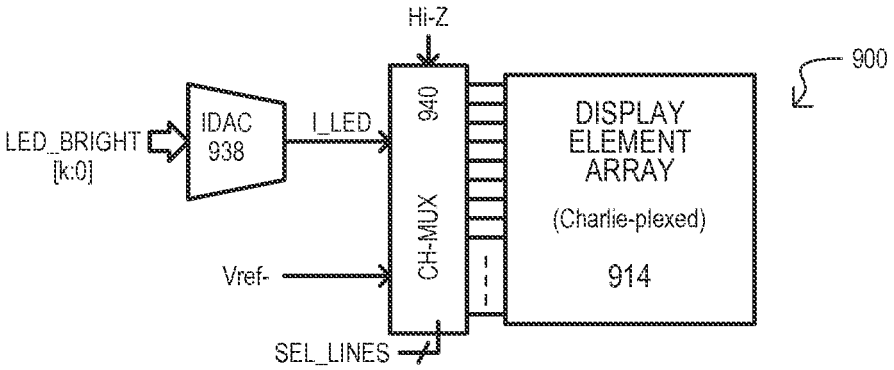
FIG. 9 is a block schematic diagram of a system that can provide DCI to display elements according to a further embodiment.

FIG. 9 is block schematic diagram of a DCI system 900 according to a further embodiment. A system 900 can be one particular implementation of that shown In FIG. 7.

In the embodiment of FIG. 9, a current generator can be a current digital-to-analog converter (iDAC) 938, which can generate a current in response to digital values LED_BRIGHT. Also, in the particular embodiment shown, display element array 914 can have a Charlie-plexed configuration. Accordingly, the generated current I_LED can be applied via a Charlie-plexing circuit 940, which can selectively connect one line to the current I_LED, another line to a predetermined voltage −Vref (to complete a current path through a selected display element), while all other lines are placed into a high impedance state Hi-Z.

Figure 10:
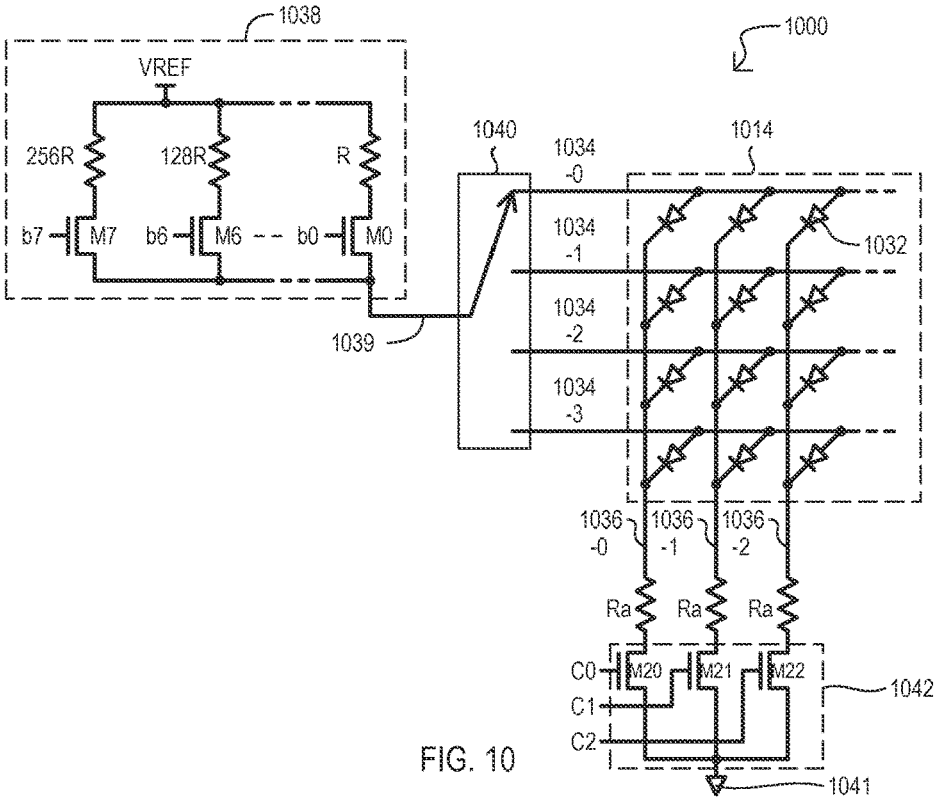
FIG. 10 is a block schematic diagram of a system that can provide DCI to display elements with a weighted resistor structure according to an embodiment.

FIG. 10 is a block schematic diagram of a DCI system 1000 according to another embodiment. System 1000 can also be one particular implementation of that shown in FIG. 7. A system 1000 can include iDAC 1038, switching circuit 1040, and an array 1014 of LEDs (one shown as 1032). iDAC 1038 can include weighted resistors having resistances R to 256R and current switches M0 to M7 connected in series between a reference voltage VREF and current source node 1039. Current switches (M0 to M7) can be controlled by corresponding input bit values (b0 to b7). Current switches are insulated gate field effect (e.g., MOS) transistors in FIG. 10, however any suitable switching element can be used.

Switching circuit 1040 can connect current source node 1039 to any of multiple rows (1034-0 to -3) within LED array 1014. Column switching circuit 1042 can connect any of multiple columns 1036-0 to -2 to a current sink node 1041. Column switching circuit can include resistances Ra in series with column switches M20 to M22. Column switches are insulated gate field effect transistors, however any suitable switching element can be used.

Referring still to FIG. 10, each bit of data (b0-b7) can indicate an intensity of brightness of a corresponding LED (e.g. 1032). Each bit (b0-b7) is used to drive its corresponding current switch (M0 to M7) which controls the current going through one resistor (R to 256R). The value of resistors keeps doubling from the right (R) to the left (256R). The currents from all selected resistors (R to 256R) then converge at current source node 1039. The amount of current directly reflects the brightness requirement of one LED. The converged current is then passed through switching circuit 1040 to the selected LED.

In the particular embodiment shown, to select a particular LED (e.g., 1032), conventional multiplexing can be used. An LED (e.g., 1032) can be activated when the corresponding row signal (e.g., 1034-0) and column signal (e.g., C2) are activated. Because a variable current is applied to a selected LED, a regular digital MUX type circuit may not be suitable. Therefore, switching circuit 1040 can include analog switches to inject current to the corresponding LED row (1034-0 to 1034-3). Similarly, switching elements within iDAC 1038 and/or column switching circuit 1042 can be low resistance elements, such as low-resistance MOS transistor, since the typical current requirement of LED can be relatively high (e.g., 20 mA).

Figure 11:
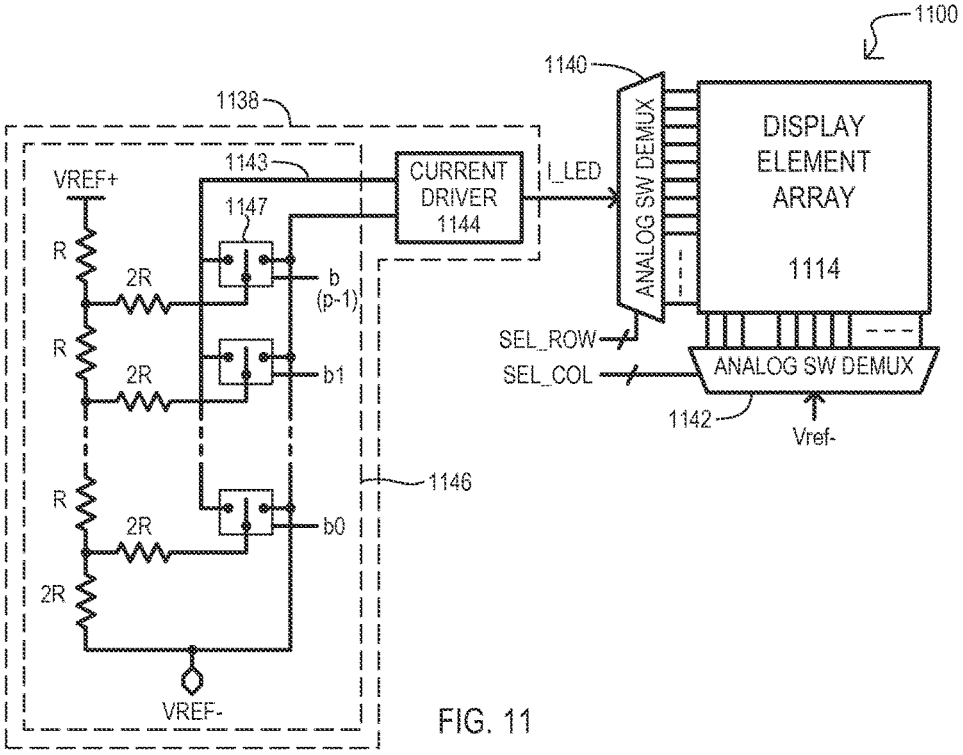
FIG. 11 is a block schematic diagram of a system that can provide DCI to display elements with an R-2R resistor ladder structure according to an embodiment.

FIG. 11 is a block schematic diagram of another DCI system 1100 according to another embodiment. FIG. 11 can be one implementation of that shown in FIG. 7. FIG. 11 includes items like those of FIG. 8, including a display element array 1114, DMUX circuit 1140 and column DMUX circuit 1142.

FIG. 11 shows how a current generator 1138 can be an R-2R type iDAC. Current generator 1138 can include an R-2R resistance ladder 1146, control switches (one shown as 1147), and a current driver circuit 1144. According to received bit values b0 to b(p−1), control switches (e.g., 1147) can switch their corresponding ladder leg to an input node 1143 or a reference node (VREF−). R-2R resistance ladder 1146 can provide a resistance proportional to the digital value (b0 to b(p−1)). This current can be amplified by current driver 1144 to present variable current I_LED for application to display element array 1114.

It is understood that one can implement the DCI techniques described in both the discrete-component level and integrated-circuit level. It also understood that the various different techniques can be combined in other ways in alternate embodiments. In fact, many variations can be derived for the above approach. In addition to an R-2R resistor ladder or iDAC, one could use a potentiometer or voltage based DAC as all or part of a current generator.

While embodiments can reduce the number of data lines used to control display elements, using interleaved PWM approaches and equivalents, embodiments can also reduce the number of control lines needed to activate display elements in cases where such display elements are arranged into color groups, such as red-green-blue (RGB) LEDs.

According to embodiments, the average number of multi-colored display elements (e.g., RGB LEDs) controlled by one line can be reduced over conventional approaches, such as that shown in FIG. 23. Embodiments can be conceptualized as incorporating Charlie-plexing and color switching, and will be referred to herein as shared color control Charlie-plexing (SCCC).

Figure 12:
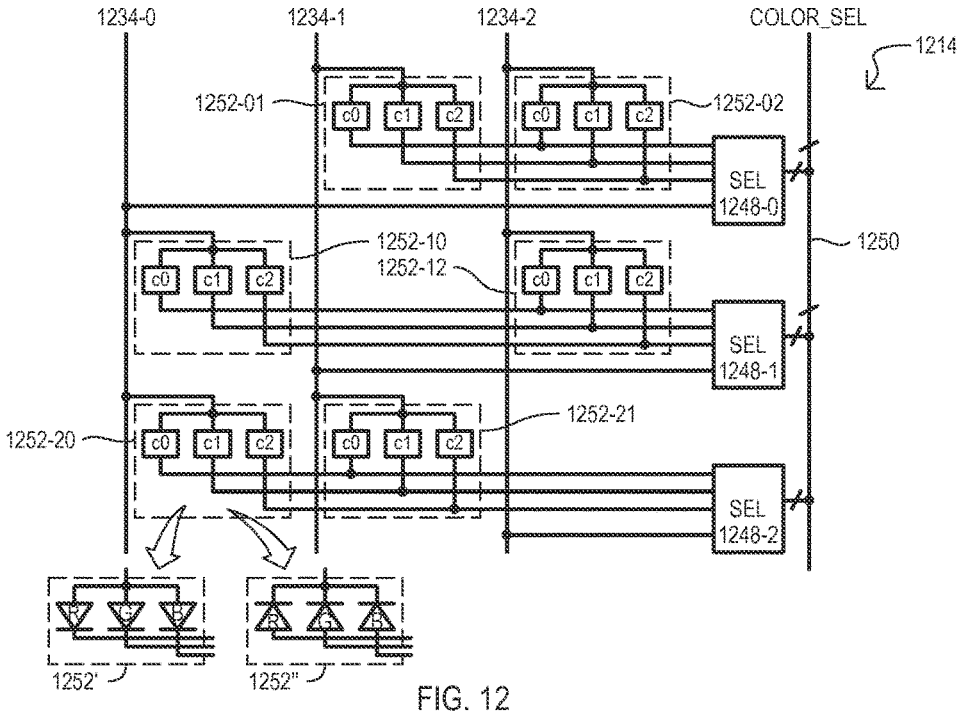
FIG. 12 is a block schematic diagram of an array of display elements having shared color control Charlie-plexing (SCCC) according to an embodiment.

FIG. 12 shows an SCCC array 1214 according to an embodiment. SCCC array 1214 can include multi-colored display element groups 1252-01 to -21 and color select circuits 1248-0 to -2. Element groups (1252-01 to -21) can include display elements of different colors (c0, c1, c2), each having a first and second terminal. Display elements of a same group can have first terminals commonly connected to one access line (1234-0 to 1234-2). Second terminals of the display elements (c0, c1, c2) can be connected to a color select circuit (1248-0 to -2). For example, display elements of group 1252-10 can have first terminals commonly connected to access line 1234-1, and second terminals connected to color select circuit 1248-0.

Color select circuits (1248-0 to -2) can be connected to the second terminals of multiple element groups (1252-01 to -21), and to one access line (1234-0 to -2). Each color select circuit (1248-0 to -2) can selectively connect the second terminals of one color display element to its corresponding access line according to color selection signals (COLOR_SEL). For example, color select circuit 1248-0 can connect the second terminal of one of display elements c0, c1 or c2 from element groups 1252-01 and 1252-02 to access line 1234-0.

As in the case of other embodiments herein, display elements (c0, c1, c2) can take any suitable form, including those that emit and/or reflect light. However, such display elements present different colors. FIG. 12 shows two very particular examples display element groups: an RGB LED with a common anode configuration 1252' and an RGB LED with a common cathode configuration 1252".

Referring still to FIG. 12, if it is assumed that the total number of IOs to the array is 3k+1, the number of IO lines for Charlieplexing is 3k−2 (i.e., the number of access lines is 3k−2), and three IOs are used to as color selection inputs (i.e., COLOR_SEL is three signals). Therefore, by letting same color display elements share a same control line, a total number of display elements that can be controlled is (3k−2)*(3k−3) and the average number of display elements controlled by one I/O is $$\frac{(3k-2)*(3k-3)}{3k+1}.$$

From the above equation, when k≥3, we derive $$\frac{(3k-2)*(3k-3)}{3k+1} > k.$$

This means that SCCC arrangements can be more efficient when the total number of controlled display elements is more than 42. Note that $$\lim_{k\to\infty} \frac{(3k-2)*(3k-3)}{(3k+1)k} = 3,$$

which means in an SCCC arrangement, the average number of display elements controlled by one IO increases by three times over a conventional approach like that shown in FIG. 23. Accordingly, SCCC arrangements are believed to be beneficial for applications such as LED displays because the total number of LEDs controlled by Charlieplexing is often much more than 42. This ability to control greater numbers of display elements with fewer IOs comes at a cost of (9k−6) switches.

Figure 13:
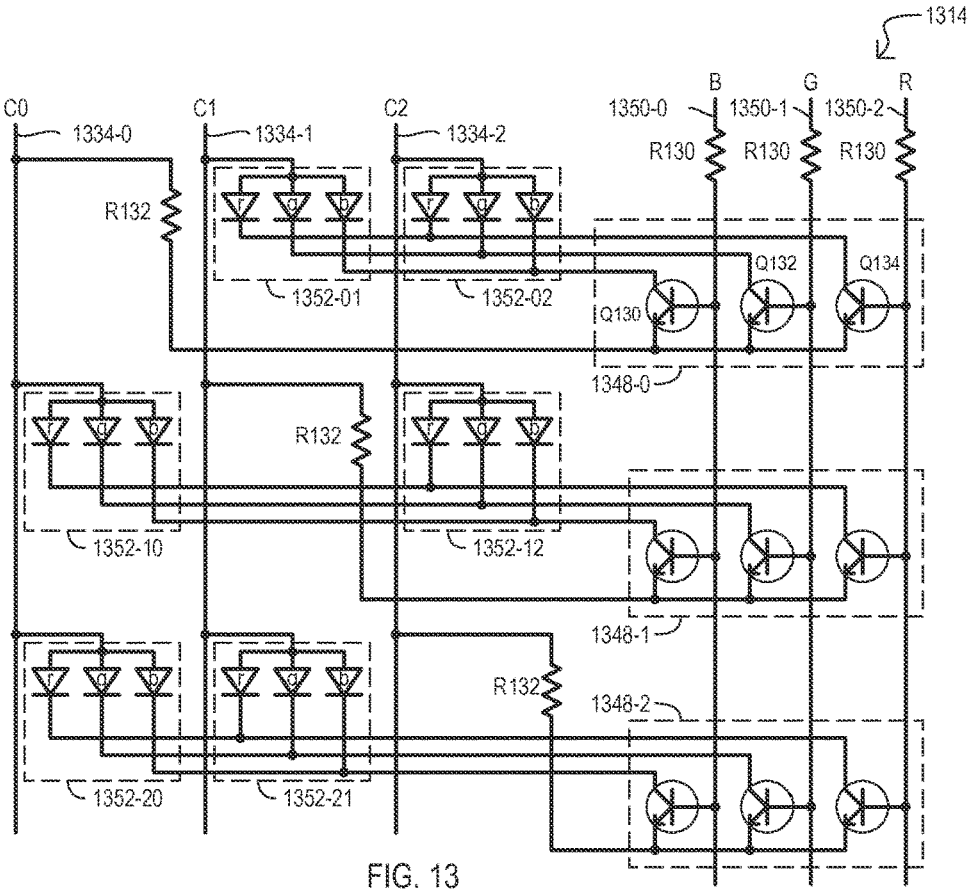
FIG. 13 is a block schematic diagram of an array of red-green-blue light (RGB) emitting diodes (LEDs) having SCCC according to another embodiment.

FIG. 13 shows an SCCC array 1314 according to a more particular embodiment. SCCC array 1314 can be on particular implementation of that shown in FIG. 12. FIG. 13 differs from FIG. 12 in that element groups 1352-01 to -21 are shown to include RGB LEDs having a common anode configuration. In addition, color select circuits 1348-0 to -2 are shown to include npn bipolar transistors (e.g., Q130 to Q134). However, any other suitable switching element can be used (e.g., MOS type transistors, analog switches, etc.).

The embodiment of FIG. 13 also includes resistors R132 connected between each access line (1334-0 to -2) and its corresponding color select circuit (1348-0 to -2). In addition, resistors R130 are connected to color select lines 1350-0 to 1350-2.

From the above it is understood, to select the red LED of element group 1352-01, access line C1 can be driven to a suitable high voltage, access line C0 can be driven to a suitable low voltage, and color select line 1350-2 can be driven to voltage suitable to turn on transistor Q134.

While the embodiments of FIGS. 12 and 13 show groups with elements of three different colors, other embodiments can include groups of larger or smaller numbers of different colors.

While embodiments can include systems for controlling display elements, embodiments can also include assemblies for mounting display elements and their corresponding control electronics.

According to embodiments, an assembly can include a connector-less printed circuit board (PCB) stack of at least two PCBs. Each PCB can mount components on only one side and leave the other side blank to enable the two PCBs to be connected (e.g., soldered) together back to back. Such an arrangement can remove the need for connectors between display elements and control components, which can be costly.

Figure 14A:
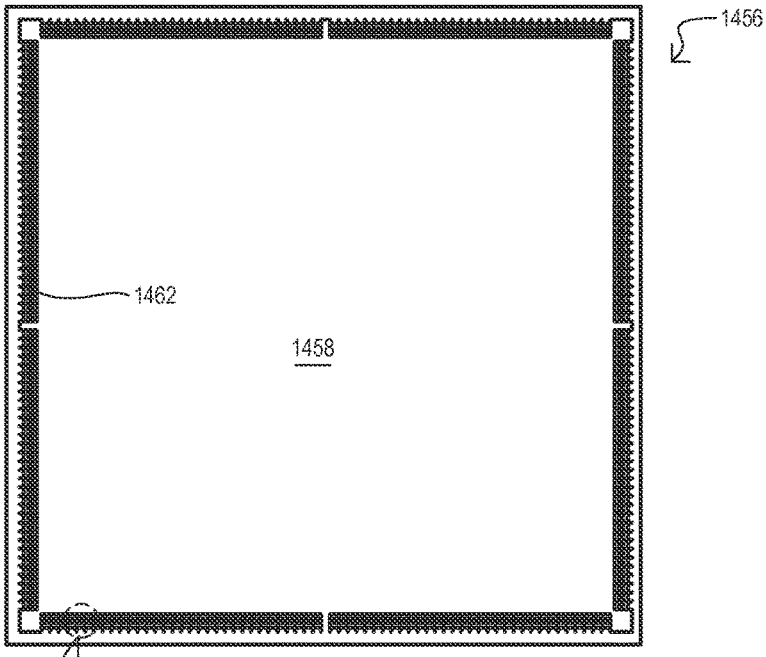
FIGS. 14A to 14G are diagrams showing an assembly and methods according to embodiments.

FIGS. 14A to 14G show parts of an assembly and corresponding methods according to embodiments. FIG. 14A is a plan view of a first PCB 1456 according to an embodiment. It is understood that first PCB 1456 can be mated with a second PCB (described in more detail below) with a connectorless attachment. A first PCB 1456 can have a first side (or face) 1458 and a second side (or face) (not shown). A second side can be designed to receive display element components, such as arrays of LEDs, as but one example. In contrast, a first side 1458 can be designed to not receive any components. However, a first side 1458 can include conductive bonds (one shown as 1462) formed thereon that can provide signal paths to display elements mounted on the second side. In the embodiment shown, conductive bonds (e.g., 1462) can be conductive pad structures that are formed on edges of the first PCB 1456.

Figure 14B:
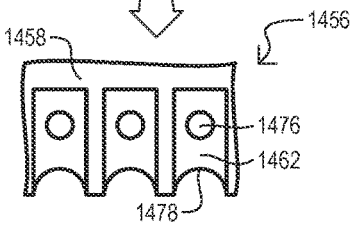
Figure 14C:
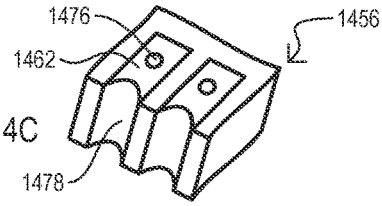

FIG. 14B is a partial plan view and FIG. 14C is a partial perspective view of a first PCB 1456 like that of FIG. 14A. FIGS. 14B and 14C shows conductive bonds according to an embodiment in more detail. Referring to FIGS. 14B and 14C together, a first PCB can include conductive bonds 1462 having a rectangular shape and a through holes 1476 that extend into the first PCB 1456. Further, conductive bonds 1462 can have an arc shape indentation 1478 that extends into the edge of the first PCB 1456. The arc-shaped indentation 1478 can allow solder to reliably connect two PCBs and the through hole 1476 can allow extra solder to flow when two PCBs are pressed tightly against each other. The through hole 1476 can also reduce the chance of short circuits. In some embodiments, a conductive bond 1462 can also exist on the second side (not shown) of the first PCB 1456.

Figure 14D:
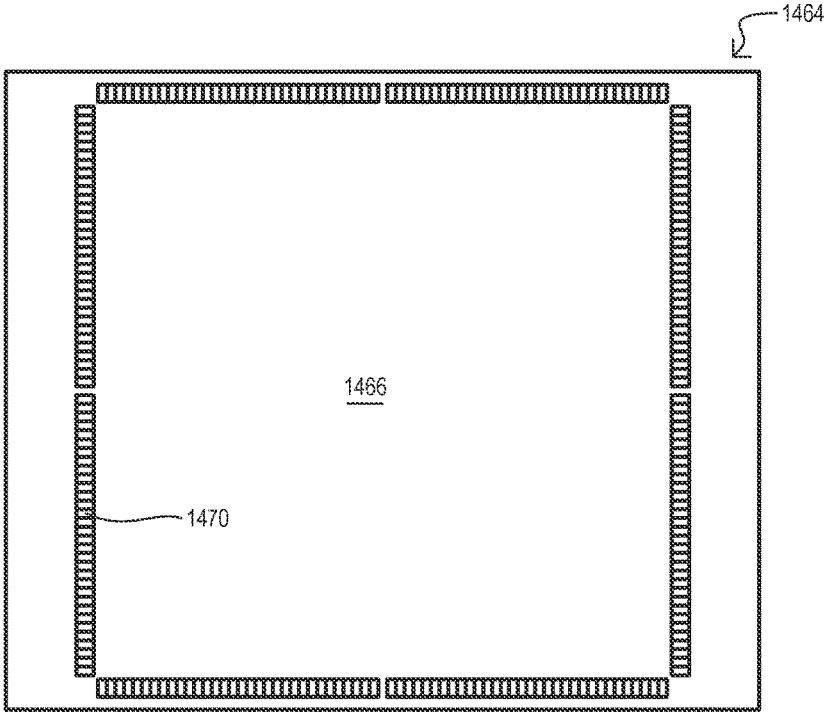

FIG. 14D is a plan view of a second PCB 1464 according to an embodiment. It is understood that second PCB 1464 can be mated with a first PCB 1456 shown in FIG. 14A in a connectorless manner. A second PCB 1464 can have a first side (or face) 1466 and a second side (or face) (not shown). A second side can be designed to receive control components for controlling display elements mounted in a first PCB 1456. A first side 1466 can be designed to not receive any components and can include conductive bonds (one shown as 1470) formed thereon that can provide signal paths to control elements mounted on the second side.

Conductive bonds 1470 can be aligned with conductive bonds 1462 on the first side 1458 of the first PCB 1456. This enables the first sides of both PCBs (1456 and 1464) to be mated with one another, thus providing signal paths between control components mounted on the second side of the second PCB 1464, and display elements mounted on the second side of the first PCB 1456.

Figure 14E:
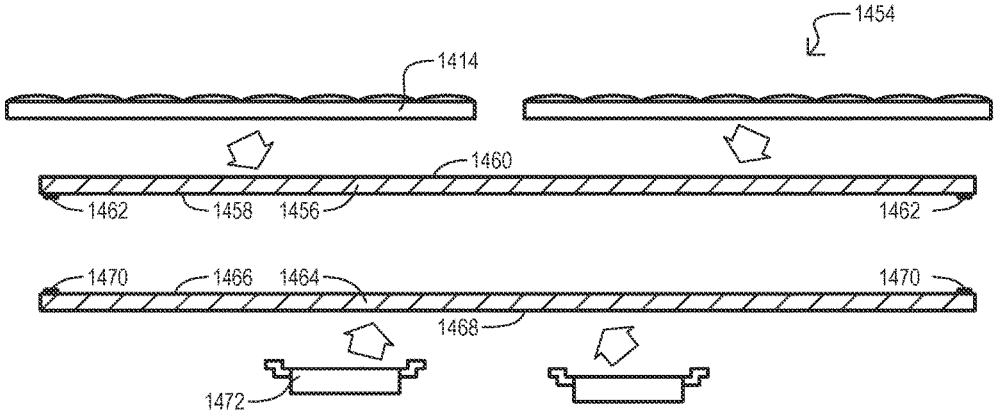
Figure 14F:
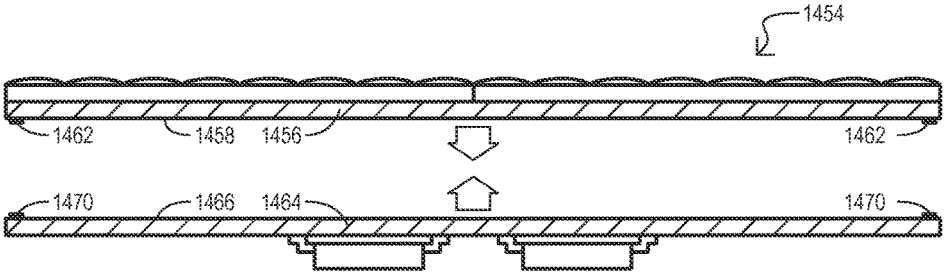
Figure 14G:
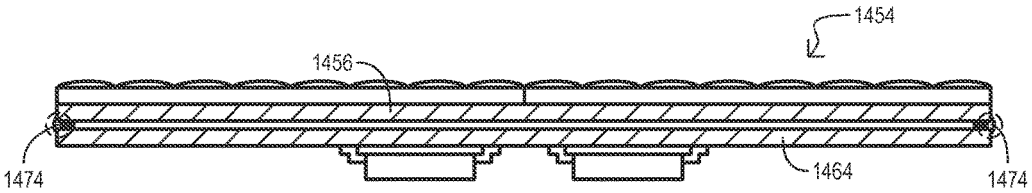

FIGS. 14E to 14G show a method of assembling PCBs like those of FIGS. 14A and 14D according to a particular embodiment. Referring to FIG. 14E, display element components (one shown as 1414) can be mounted on a second side 1460 of first PCB 1456. In addition, control electronic components (one shown as 1472) can be mounted on a second side 1468 of a second PCB 1464. Notably, components are not mounted on a first side 1458 of first PCB 1456 nor a first side 1466 of a second PCB 1464.

Referring to FIG. 14F, first and second PCBs (1456 and 1464) can be mated. It is noted that conductive bonds 1470 of second PCB 1470 are aligned with conductive bonds 1462 of first PCB 1456.

Referring to FIG. 14G, first and second PCBs (1456 and 1464) can be attached at their aligned conductive bonds 1462/1470 to from bond connections 1474. In one embodiment, conductive bonds (1462 and/or 1470) of one or both PCBs (1456 and 1464) can have a structure as shown in FIGS. 14B and 14C, or an equivalent structure, and attachment can be by soldering. However, alternate embodiments can include different attachment types, including conductive, mechanical attachment.

While embodiments can include assemblies, systems and methods which can provide for a very fast spatial light modulator which generates display contents, other embodiments can include light guiding/modulating mechanisms which can aim images to different spatial locations, for applications such as 3D imaging.

In the following section, examples of such embodiments will be described in more detail which can include displacement between an optical component and a display component to deliver images, such as those for a 3D space.

Figure 15:
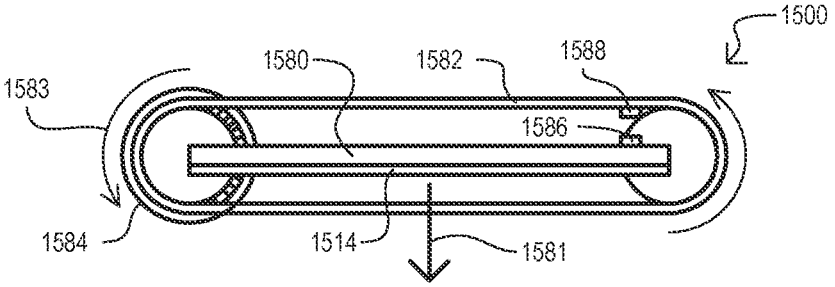
FIG. 15 is a top plan view diagram of a conveyor belt like system that can provide three-dimensional (3D) imaging according to an embodiment.

FIG. 15 is a top view of a system 1500 according to an embodiment. A system 1500 can include a display structure 1580, a modulating structure 1582, rotational driver 1584, position sensor 1586 and position indicator 1588. A display structure 1580 can include an array of display elements 1514 which can be conventional, or according to the various embodiments shown herein, or equivalents. Display elements 1514 can project in the image direction 1581.

In some embodiments, a modulating structure 1582 can be a flexible track formed of multiple modulating members, which, when moved in front of display structure 1580, can displace presented images. Modulating members can include any suitable structures for displacing images including those that refract, reflect and occlude (e.g., parallax barrier).

In the embodiment shown, a modulating structure 1582 can surround display structure 1580, and be driven by rotational driver 1584 to move around the display structure 1580, as shown by arrow 1583, and thereby provide a modulating effect. Since this resembles a conveyor belt, it will be referred to as a "conveyor belt configuration". Driven by an external force (e.g., rotational driver 1584), modulating structure 1582 can move at a controlled speed. In one embodiment, such movement can be at a constant speed to reduce the complexity of mechanical design and motor control. Display elements 1514 can remain stationary.

In such a configuration, a relative position between a pixel (presented by one or more display elements 1514) or the viewable angle of a pixel can change periodically. If we denote the moving speed by s and the width of a single modulating structure (e.g., lens, slat, etc.) as w, then the period is w/s. Within this period, a modulating structure can receive the light from a pixel underneath and directs its light to different angles, or occlude the pixel from particular view angles.

At the same time, a pixel needs to present contents fast enough so that the light sent to different directions can vary based on the requirement of 3D display. In order to seamlessly synchronize the mechanical movement and the display content on the panel, a system 1500 can include a position sensing mechanism. In the particular embodiment shown, such a mechanism can include position sensor 1586 and position indicator 1588. A position sensor 1586 can detect the proximity of the position indicator 1588 and thereby determine speed/position of modulating structure 1582. In one very particular embodiment, a position indicator 1588 can be a magnet mounted on the modulating structure 1582. On the display panel structure 1580 (or anywhere else except on the modulating structure 1582), a position sensor 1586 can be a hall-effect sensor. Every time the magnet passes by the hall-effect sensor, it indicates a completed rotation. This can be used to reset the offset measurement between the display elements 1514 and the modulating structure 1582.

Figure 16:
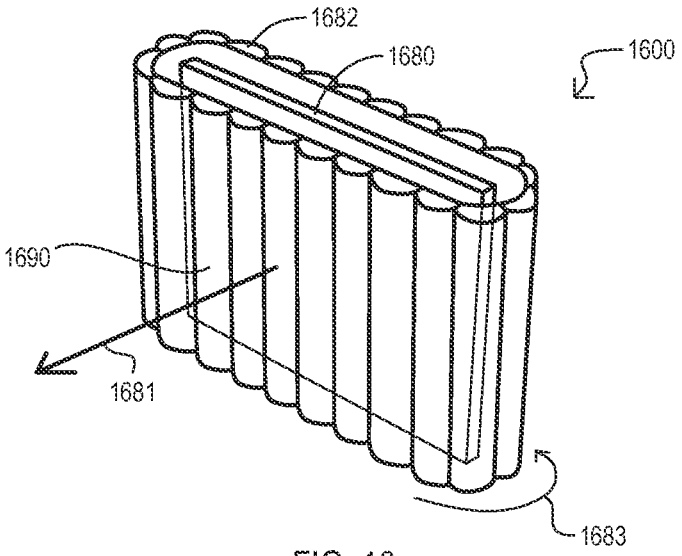
FIG. 16 is a perspective view of a conveyor belt like system that can provide 3D imaging according to another embodiment.

FIG. 16 is a perspective view of a system 1600 according to a particular embodiment. System 1600 can be one particular implementation of that shown in FIG. 15, and can include display structure 1680 that projects an image generally in direction 1681 and a modulating structure 1682 that moves as shown by arrow 1683.

In the embodiment of FIG. 16, modulating structure 1682 can be formed with lenticular lenses (one shown as 1690).

Figure 17:
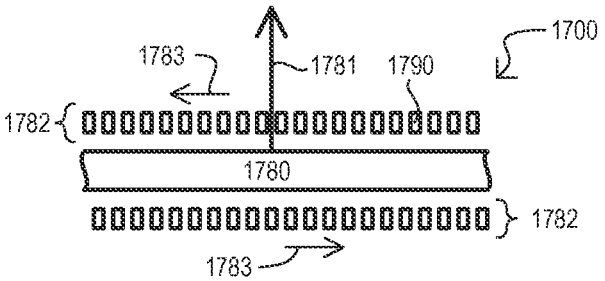
FIG. 17 is a top plan view diagram of a conveyor belt like system that can provide 3D imaging viewing according to a further embodiment.

FIG. 17 is a top plan view of a system 1700 according to another particular embodiment. System 1700 can be one particular implementation of that shown in FIG. 15, and can include display structure 1780 that projects an image generally in direction 1781 and a modulating structure 1782 that moves as shown by arrows 1783.

In the embodiment of FIG. 17, modulating structure 1782 can be formed with structures (e.g., slats) 1790 that block light from the displayed image.

Figure 18A:
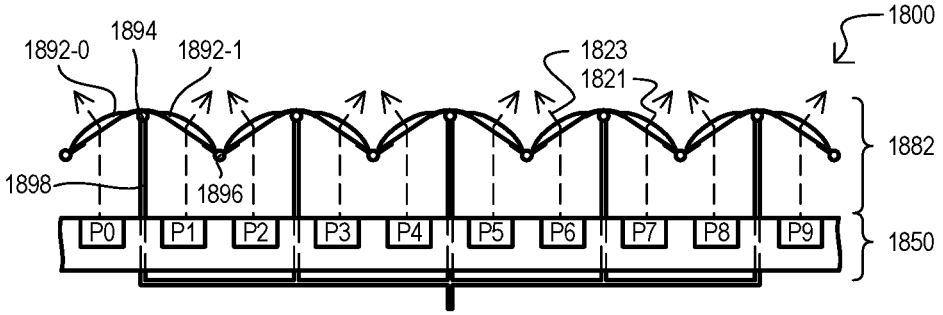
FIGS. 18A and 18B are diagrams showing a system that can provide 3D imaging viewing according to another embodiment.
Figure 18B:
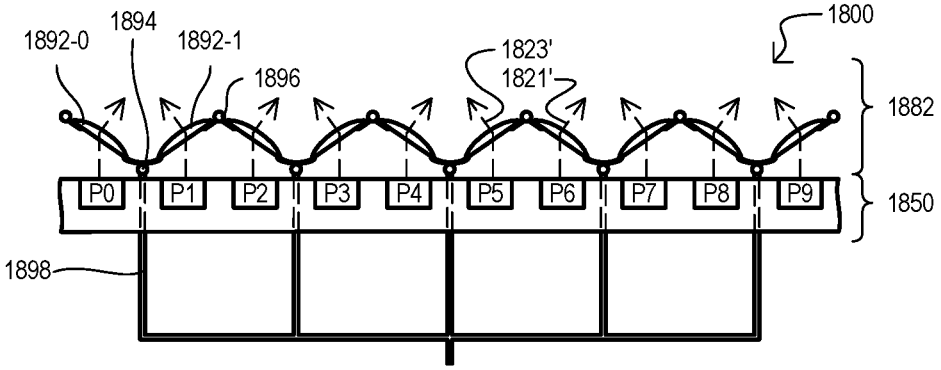

FIGS. 18A and 18B are diagrams showing a system 1800 according to another embodiment. A system 1800 can utilize the movement of microlenses to modulate from an image. Like a "conveyor belt configuration", the embodiment of FIGS. 18A/B can be conceptualized as including a display structure 1850 and a modulating structure 1882. Unlike a "conveyor belt configuration", where a modulating structure moves along one direction as a whole, in the embodiment of FIG. 18A/B, individual lenses can move separately.

Referring to FIGS. 18A/B, a display structure 1850 can have display elements that present pixels (P0 to P9). Such display elements can be of conventional arrangement or those of embodiments described herein, or equivalents.

A modulating structure 1882 can include first lenses (one shown as 1892-0), second lenses (one shown 1892-1), first joint structures (one shown as 1894), second joint structures (one shown 1896), and pushrod structure 1898. In the particular embodiment shown, there can be one lens (1892-0/1) in front of each pixel (for example, lens 1892-0 in front of pixel P0).

In some embodiments each lens (e.g., 1892-0/1) can be mounted onto a flexible surface with tension pulling them back toward display structure 1850. As but one very particular example, tension can be provided by a tensile material such as rubber. One side of the rubber can be mounted on a fixed end (for example, at second joint structures 1896) and the other side is mounted on a movable end (for example, at first joint structures 1894). Lenses (e.g., 1892-0/1) can be kept at a certain distance away from the display structure 1850 in order to keep the image through the lenses (e.g., 1892-0/1) focused. The distance can be controlled by the fixed end (for example, at second joint structures 1896). A movable end (for example, at first joint structures 1894) can then be moved towards/away from the display structure 1850. In the particular embodiment shown, a push rod structure 1898 can be attached to the movable end (for example, at first joint structures 1894) and drives its movement.

As shown by FIG. 18A, if push rod structure 1898 is driven away from the display structure, all lenses (e.g.,

1892-0/1) attached to it will follow the movement. First lenses (1892-0) can provide one view angle 1823, while second lenses (1892-1) can provide another view angle 1821.

As shown in FIG. 18B, as push rod structure 1898 is driven toward the display structure, the positions of the lenses (e.g., 1892-0/1) evolve into the configuration shown. First lenses (1892-0) can provide one view angle 1821' (which may or may not correspond to view angle 1821 of FIG. 18A), while second lenses (1892-1) can provide another view angle 1823' (which may or may not correspond to view angle 1823 of FIG. 18A).

It is noted that the movement shown by FIGS. 18A and 18B can be a continuous process and a controller can know the position of each lens (e.g., 1892-0/1) since it can control or otherwise be aware of the movement control. With such position information, a controller can precisely produce the images needed for a 3D display at any given moment.

While the embodiment of FIGS. 18A and 18B employ a mechanical force to move lenses, any suitable force can be used, including but not limited to magnetic force. As but one example, an alternating magnetic field could be applied to drive a magnet/metal installed on the moving points (e.g., 1894). In addition, the size of the lenses (e.g., 1892-0/1) need not be limited to one lens per pixel. One lens could cover multiple pixels. In particular embodiments, lenses (e.g., 1892-0/1) can be lenticular lenses.

Figure 19A:
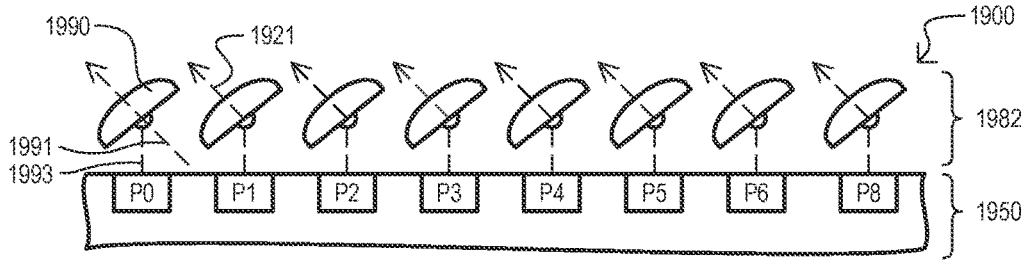
FIGS. 19A to 19C are diagrams showing a system that can provide 3D imaging viewing according to another embodiment.
Figure 19B:
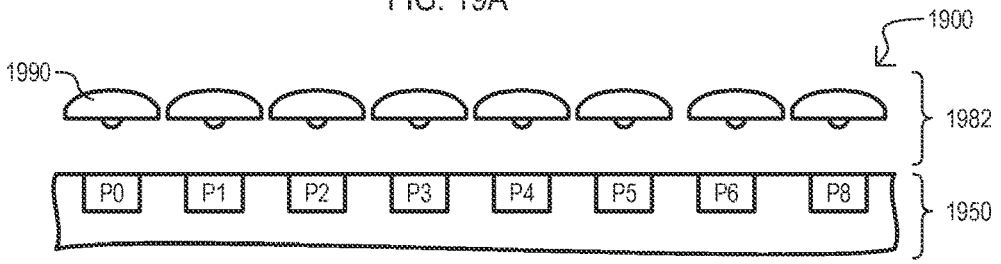
Figure 19C:
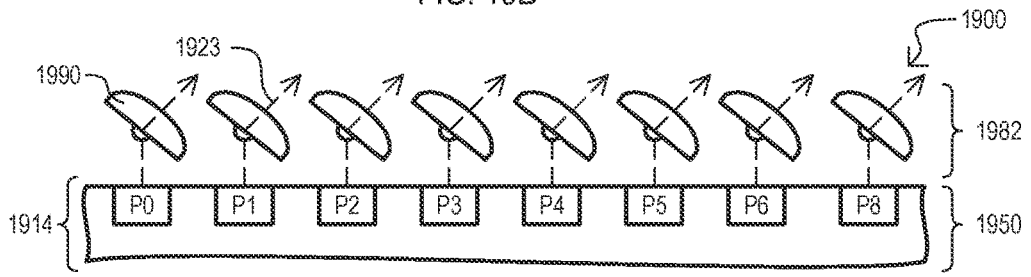

FIGS. 19A to 19C are diagrams showing a system 1900 according to another embodiment. Like the system of FIGS. 18A/B, system 1900 can utilize the movement of microlenses to modulate an image, and can be conceptualized as including a display structure 1950 and a modulating structure 1982. A display structure 1850 can present pixels (P0 to P9), and can be of conventional design or like those of embodiments described herein, or equivalents.

Like FIGS. 18A/B, a modulating structure 1982 can include a number of lenses (one shown as 1990). However, rather than rotate in different directions, lenses (e.g., 1990) can rotate towards the same direction and at a same speed and from a same initial position. Such movement can be conceptualized as being like that of a window blind. A distance between the modulating structure 1982 and the display structure 1950 can be determined by the focal length of the lenses (e.g., 1990). Setting a distance equal to the focal length of the lenses will keep the images focused and sharp.

In operation, lenses (e.g., 1990) can be rotated back and forth, as shown in FIGS. 19A through 19C. As long as the rotation generates displacement between the optical axis of lenses (one shown as 1991) and the pixel axis of each pixel column (one shown as 1993), the lens movement can lead to controllable displacements between the lens and the pixel underneath. For example, presenting different view angles such as that shown as 1921 in FIG. 19A and that shown as 1923 in FIG. 19C.

A controller can collect and analyze displacement information of the lenses (1990) to deliver the display content to various spatial coordinates on the panel.

Figure 20A:
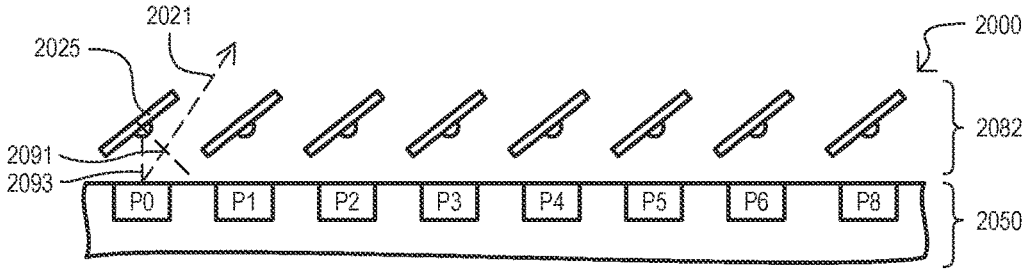
FIGS. 20A and 20B are diagrams showing a system that can provide 3D imaging viewing according to another embodiment.
Figure 20B:
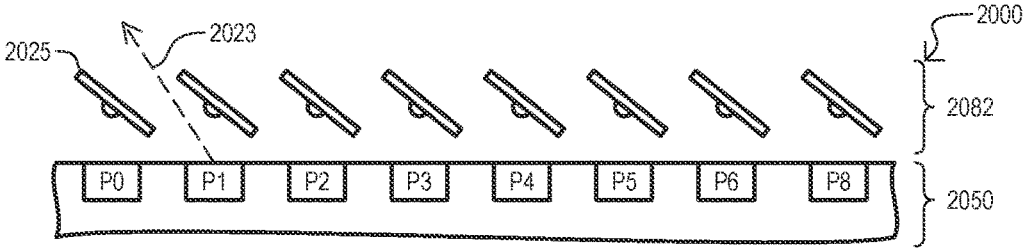

FIGS. 20A and 20B are diagrams showing a system 2000 according to another embodiment. System 2000 can operate in the same general fashion as that of FIGS. 19A to 19C. However, a modulating structure 2082 can be composed of rotating structures 2025 that are opaque (i.e., occlude the pixel). Such an arrangement can present different viewing angles like those shown as 2021 in FIG. 20A and 2023 in FIG. 2023. Otherwise, the operation of the system 2000 is understood from that of FIGS. 19A to 19C.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure to aid in the understanding of one or more of the various inventive aspects. This method of disclosure, however, is not to be interpreted as reflecting an intention that the claims require more features than are expressly recited in each claim. Rather, inventive aspects lie in less than all features of a single foregoing disclosed embodiment. Thus, the claims following the detailed description are hereby expressly incorporated into this detailed description, with each claim standing on its own as a separate embodiment of this invention.

What is claimed is:

1. A system, comprising:

a plurality of display elements that vary to form at least a portion of an image arranged into groups that each include a plurality of first lines, each coupled to at least one display element, and a plurality of latch circuits, each having an input coupled to receive a same shared data signal that transitions between different values, each latch circuit configured to latch and output the data signal on the corresponding first line to enable the different values to be driven on different first lines at the same time.

2. The system of claim 1, wherein:

the display elements are light emitting diodes (LEDs) having at least a first terminal connected to the first lines.

3. The system of claim 2, wherein:

each display element further includes a second terminal coupled to a different one of the first lines.

4. The system of claim 1, further including:

a controller configured to generate the data signal as a sequence of values corresponding to different display elements of the group that are latched in the latches.

5. The system of claim 4, wherein:

the display elements are LEDs; and the values latched by each latch form a total a pulse width that establishes a brightness of the corresponding LED over a predetermined time period.

6. The system of claim 5, wherein:

the controller includes a signal decomposition section configured to receive a pulse width modulation (PWM) value for each LED and divide the PWM value into a plurality of sub-pulses for the LED, and a sub-pulse scheduler to output the sub-pulses for the plurality of LEDs as the data signal.

7. The system of claim 4, wherein:

the controller is coupled to receive multi-bit values each corresponding to different display elements, and the sequence of values corresponding to different bit values for the display elements.

8. The system of claim 1, further including:

the display elements are arranged into an array on a display surface; and a directional view structure disposed at a distance from the display surface to enable multiscopic imaging from the display elements.

9. The system of claim 8, wherein:

the display surface is formed in a display structure; and the directional view structure comprises a plurality of moveable members.

10. A method, comprising:

enabling a plurality of display elements with single data signal, including generating the data signal to vary in time according to the display element to be enabled, latching the value of the same data signal on different first lines at different time periods, and enabling at least one display element coupled to each first line according to the value latched on its first line, wherein the display elements vary to form at least a portion of an image.

11. The method of claim 10, wherein:

latching the value of the same data signal on different first lines at different time periods includes scheduling data signal values for different display elements so that as a data value for one display element is being latched a data value for another display element can be sent to one or more other display elements.

12. The method of claim 10, wherein:

latching the value of the data signal on different first lines at different time periods generates pulse width modulation (PWM) signals for display elements connected to the different first lines; wherein the pulse width for each display element is composed of multiple sub-pulses that can be contiguous or non-contiguous with one another.

13. The method of claim 10, further including:

the display elements are arranged into an array on a display surface;

positioning display members at a distance from the display surface to produce images that vary based on a viewing position.

14. The method of claim 13, wherein:

the display members are moveable display members and producing images that vary based on viewing position includes any selected from the group of:

blocking one set of display elements while the other set of display elements is visible and then blocking the other set of display elements while the one set of display elements is visible, and repeatedly changing view angles for the display elements.

15. The method of claim 10, wherein:

the display elements comprise multi-colored display elements, each including display elements of different colors having commonly connected first terminals and separate second terminals; and enabling each display element includes selectively connecting the second terminals of same colored display elements to one of the access lines in response to color select values, while the common first terminals of the display elements are connected to other of the access lines.

16. A system, comprising:

a plurality of display elements arranged into groups on a display surface;

an element drive circuit for enabling the display elements; and a view structure disposed at a distance from the display surface having moveable members that periodically vary the visibility of at least one set of display elements from that of another set of display elements to thereby enable multiscopic imaging from the display elements.

17. The system of claim 16, further including:

the moveable members each have long edges and short edges and are arranged parallel to one another; and a drive structure coupled to the moveable members to orient the members between at least first angle and second angles with respect to the display surface.

18. The system of claim 16, further including:

the moveable members include first moveable members and second moveable members;

hinge structures connected to first long edges of adjacent first and second moveable members to enable the moveable members to rotate proximate the first long edges;

a drive structure having drive members coupled to second long edges of the first and second moveable members to move second long edges to different distances from the display surface.

19. The system of claim 16, wherein:

the element drive circuit comprises a current generator circuit that generates a current that varies in magnitude according to a property of a display element, and a routing structure configured to apply the current to at least one display element in response to select data.

20. The system of claim 16, wherein:

the plurality of moveable members are connected to form a track-like structure, and a drive unit to rotate the track-like structure around the display structure.

* * * * *